United States Patent [19]

Walega

[11] Patent Number: 4,621,384

[45] Date of Patent: Nov. 11, 1986

[54] STEAM TOE PRESS

[75] Inventor: William Walega, Hollis, N.H.

[73] Assignee: International Shoe Machine Corporation, Nashua, N.H.

[21] Appl. No.: 814,828

[22] Filed: Dec. 30, 1985

[51] Int. Cl.[4] ..... A43D 11/00; A43D 95/00

[52] U.S. Cl. ..... 12/54.2; 12/54.1; 12/51

[58] Field of Search ..... 12/54.1, 54.2, 54.3, 12/53.1, 53.5, 51, 53.4; 219/215; 69/48

[56] References Cited

U.S. PATENT DOCUMENTS

| | | | |
|---|---|---|---|
| 2,234,547 | 3/1941 | Bazzoni | 12/53.1 |
| 2,236,592 | 4/1941 | Better | 12/54.2 |
| 2,280,894 | 4/1942 | Cushman | 219/38 |
| 3,039,288 | 6/1962 | La Torre et al. | 69/7 |
| 3,440,672 | 4/1969 | Fromantin | 12/54.3 |
| 3,442,743 | 5/1969 | Schultz et al. | 156/245 |
| 3,736,611 | 6/1973 | Dreibholz | 12/54.2 |
| 3,805,561 | 4/1974 | Bullock | 68/5 C |
| 3,869,815 | 3/1975 | Bullock | 38/77.6 |
| 4,017,929 | 4/1977 | Capuano | 12/16.4 |
| 4,508,956 | 4/1985 | Prichard | 12/54.1 |

*Primary Examiner*—Henry S. Jaudon

*Assistant Examiner*—Steven N. Meyers

*Attorney, Agent, or Firm*—Robert Shaw

[57] ABSTRACT

A steam press for steaming the toe region of a footwear upper, that includes a contoured activator to receive the toe portion of the upper and operable to heat and apply steam to moisturize the toe portion. The contoured activator includes a contoured silicone cushion and a felt-covered contoured steam pad to engage the top part of the upper and a lower heated activator housing contoured to the contour of the contoured steam pad and positioned to mate with the contoured steam pad and press the upper therebetween. The contoured steam pad is mechanically interconnected to move away from and toward the heated activator pad respectively to receive the upper and then press the upper between the contoured steam pad and the heated activator housing. A steam generator is connected to receive water in the liquid state and is operable to convert the water to steam. A water injector is connected to introduce a metered and precisely controllable amount of water to the steam generator which converts the water to steam that flows into the silicone cushion, then into the contoured steam pad the thence to the upper.

12 Claims, 8 Drawing Figures

STEAM TOE PRESS

The present invention relates to mechanisms to steam the toe of a shoe or other footwear upper prior to forming the upper upon a last.

To simplify the explanation reference is made hereinafter mostly to shoes but it is to be understood that the steam toe press disclosed is useful for footwear uppers in general. It is common practice in the shoe industry to soften the toe of a shoe prior to placing it upon a last by the application of steam to the toe of the shoe to make the toe flexible and more easily formable about the last. The application of the steam is not without problems. A significant problem is that often the steam contains water droplets which stain the upper, or the steam may be too hot to render the upper damp to the degree needed, for the object of applying the steam is to render the upper damp without wetting. Ideally the steam is sufficiently hot that it does not mark the upper yet is not so hot that it will not perform the dampening function.

Accordingly, it is an object of the present invention to provide a steam toe press that will apply steam to a shoe upper in a way that will make the shoe upper pliable for immediate placement of the upper on a last.

This and still further objects are addressed hereinafter.

The foregoing objects are achieved, generally, in a steam toe press for steaming the toe region of a footwear upper, that includes: a contoured activator to receive the upper and operable to heat the toe portion of the upper, which contoured activator includes a contoured cushion and a contoured steam pad, the latter to engage the top of the upper, and a heat activator housing contoured to the contour of the contoured steam pad and positioned to mate with the contoured steam pad and press the upper therebetween, the contoured steam pad being operable to move away from and toward the heat activator housing respectively to receive the upper and then press the upper therebetween, the contoured activator further including a steam generator connected to receive water in a liquid state and operable to convert the water to steam, which steam generator includes a water injector mechanism connected to introduce a precisely controllable amount of water to the steam generator which converts the water to steam that flows into the contoured cushion, thence to the contoured cushion steam pad and thence to the upper.

The invention is hereinafter described with references to the accompanying drawing in which.

Figure 1:
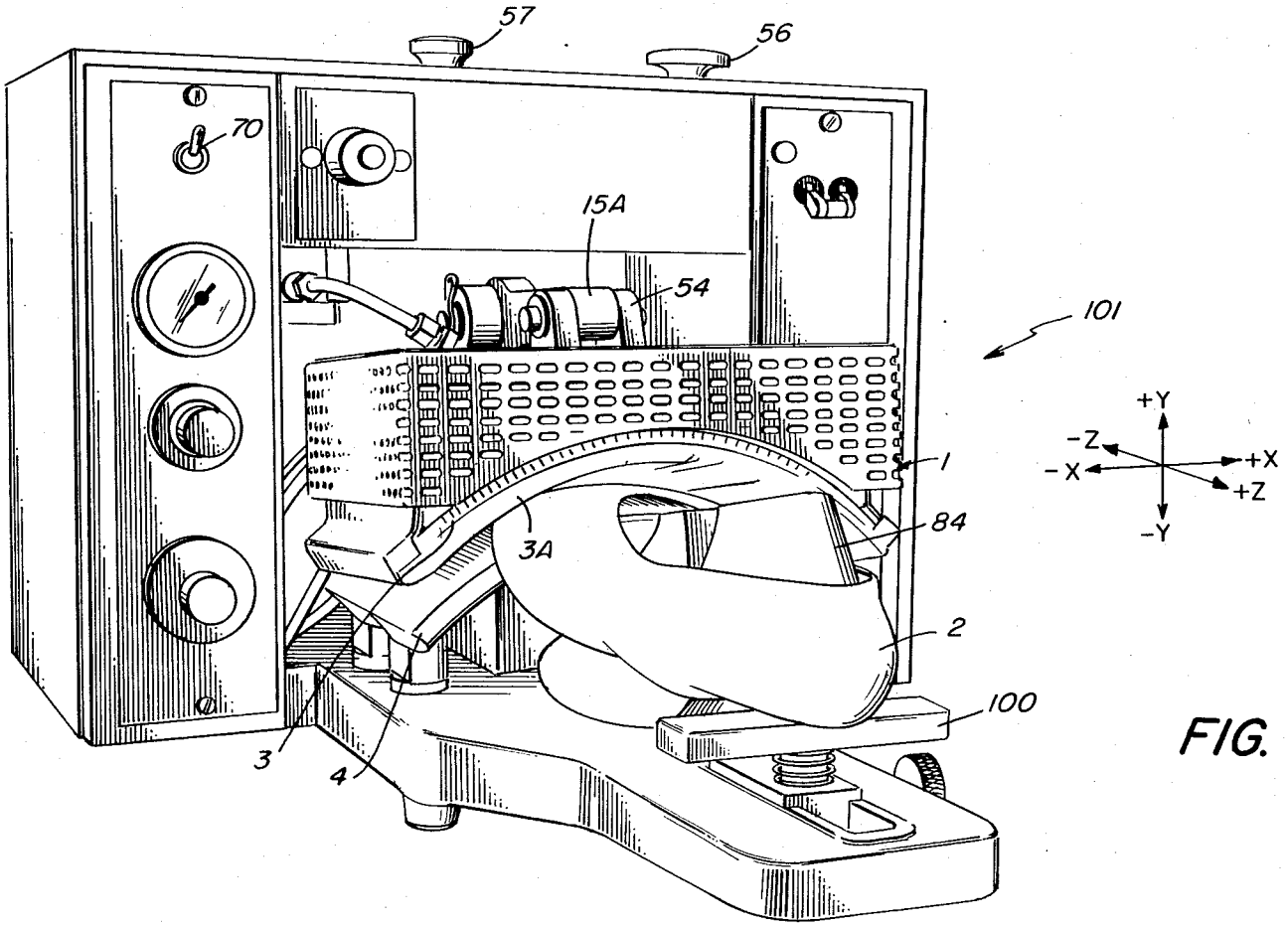
FIG. 1 is an isometric left front view of a preferred embodiment of a steam toe press of the present invention, showing a shoe upper in position for steaming, but with steam pads open.
Figure 2:
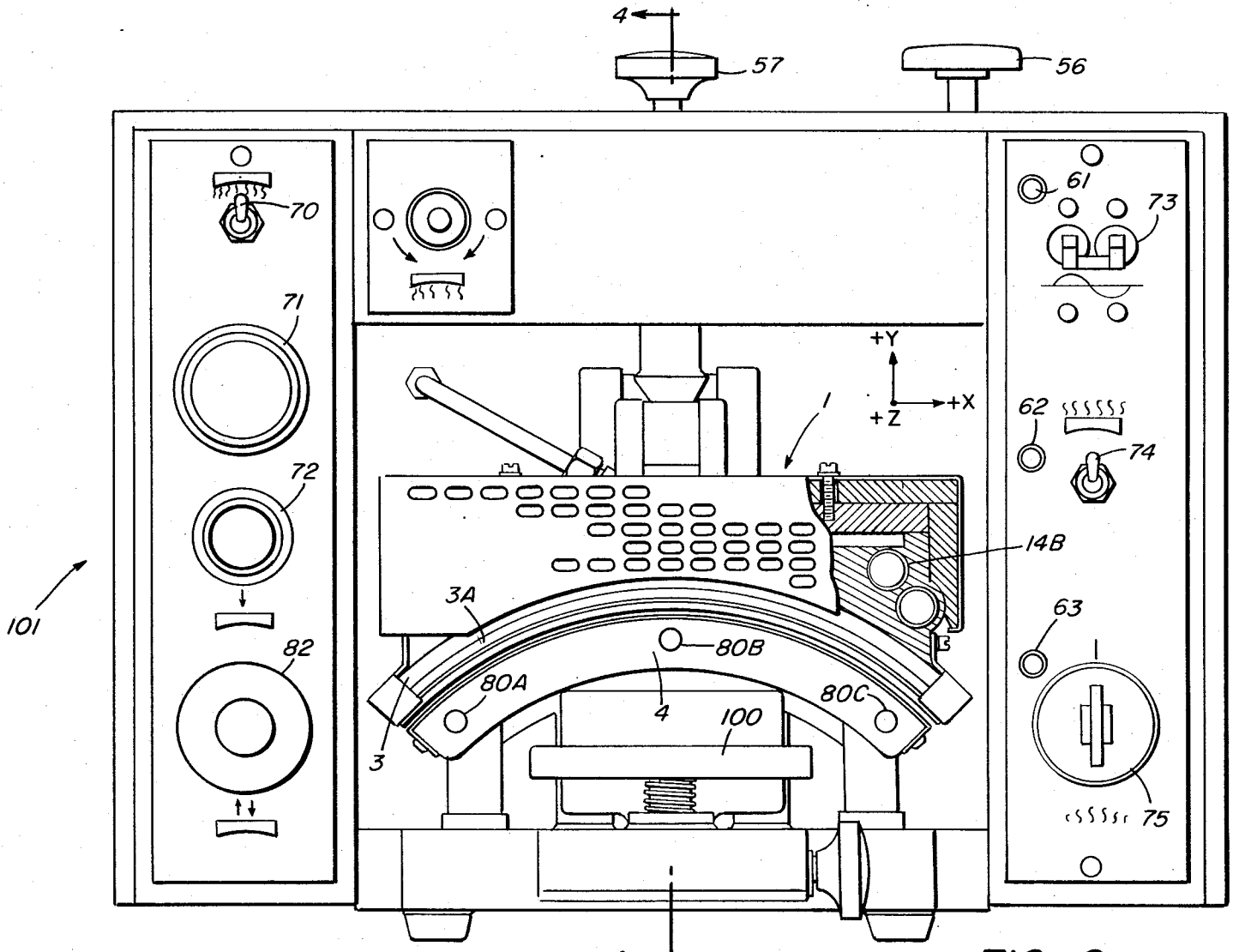
FIG. 2 is a front elevation view of the steam toe press of FIG. 1 with the steam pads closed but without an upper.
Figure 3:
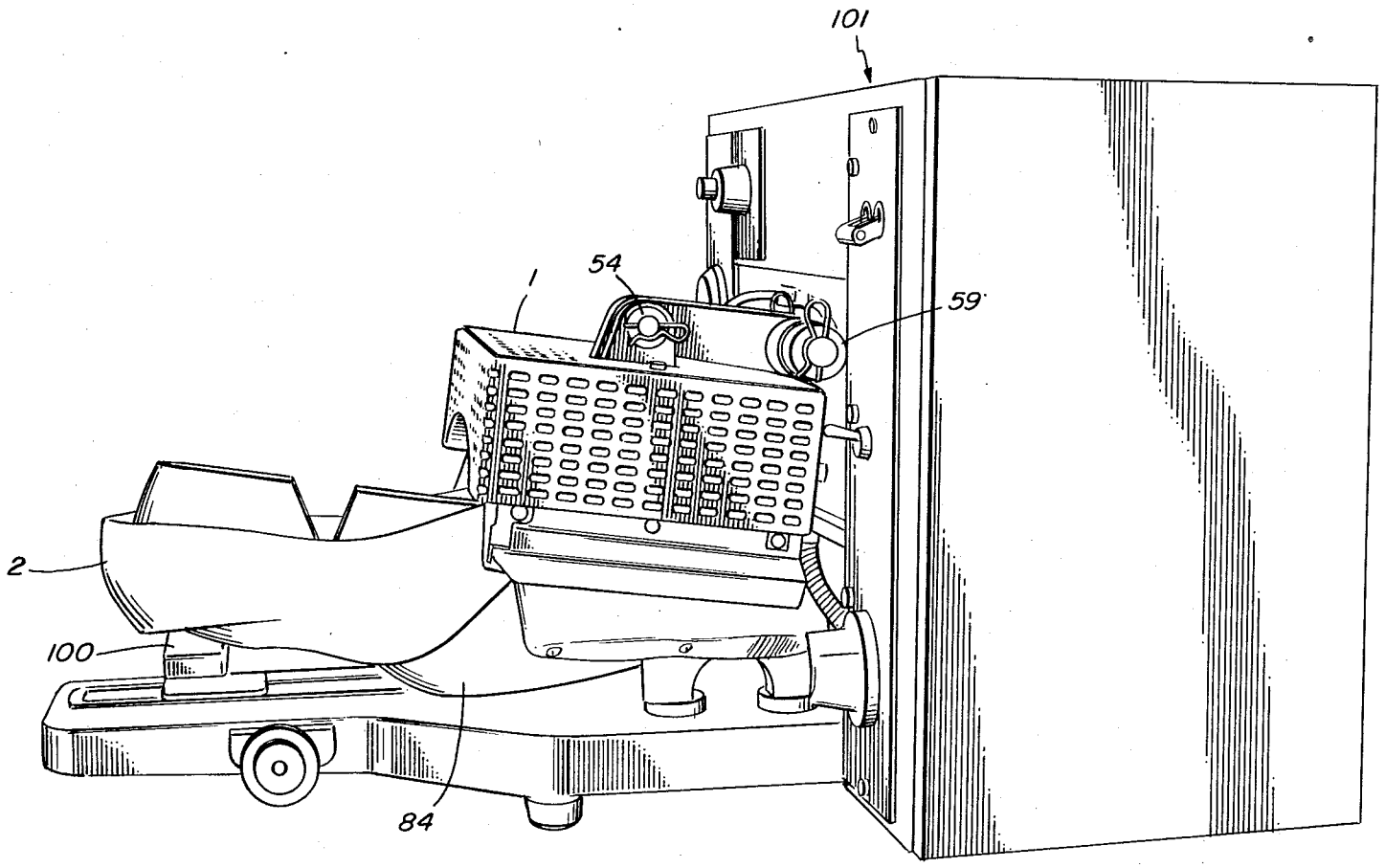
FIG. 3 is a right-side isometric view of the steam toe press of FIG. 1 and again the steam pads are not pressed upon another.

Turning now to FIGS. 1–3, there is shown at 101 a steam toe press for steaming the toe region of a shoe (or other footwear) upper 2 of leather, plastic or the like. The press 101 includes a contoured activator 1 to receive the upper 2, the activator 1 being operable to heat the upper by the introduction of steam thereto. The steam, ideally, is at a temperature just slightly above the saturation temperature so that it enters the upper as a moist gas which permeates the upper to render it hot and damp, but not wet. The contoured activator 1 includes a porous top silicone cushion 3 and a disposable porous felt covered steam pad 3A to engage the top of the upper 2 and adapted to receive the steam which permeates through the pad 3A to the upper 2. A lower, Teflon-covered, heat-activator housing 4, contoured to the contour of the contoured steam pad 3A and positioned to mate with the steam pad 3A, is operable, when the two are closed upon one another, to press the toe portion of the upper therebetween. In FIGS. 1 and 3 the pad 3A and the activator housing 4 are separated from one another to permit introduction of the upper 2 therebetween and in FIG. 2 the pad 3A and the activator housing 4 are closed upon one another, but no upper is shown in FIG. 2. (The linkages to permit appropriate movement from the open position to the closed position is quite important and is discussed later in detail with reference to FIG. 4.) When the pad 3A and activator housing 4 are closed (FIG. 2) the upper 2 is pressed therebetween and water vapor is introduced to the upper top surface to heat and moisturize the same while the lower upper surface (thermo-activated toe) is activated by the heated lower activator housing 4. It is noted above to be important that the water enter the upper as a gas (or vapor) to achieve the moisturizing of the upper without wetting the upper. In FIG. 1 the front of the press (+Z) is nearest the viewer the back of the press (−Z) is farthest from the viewer.

Figure 5:
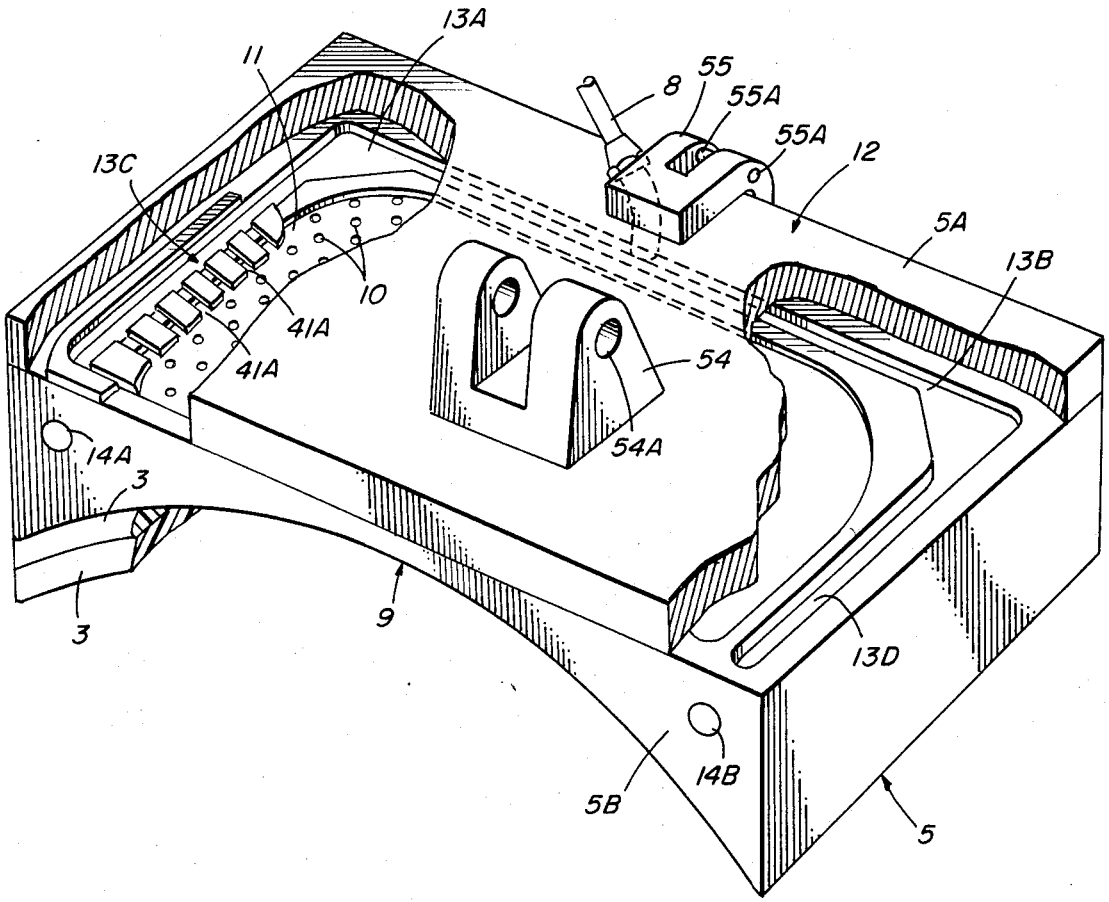
FIG. 5 is an isometric view, partly cutaway, showing a steam generator to produce the steam in the steam toe press of FIG. 1.
Figure 7:
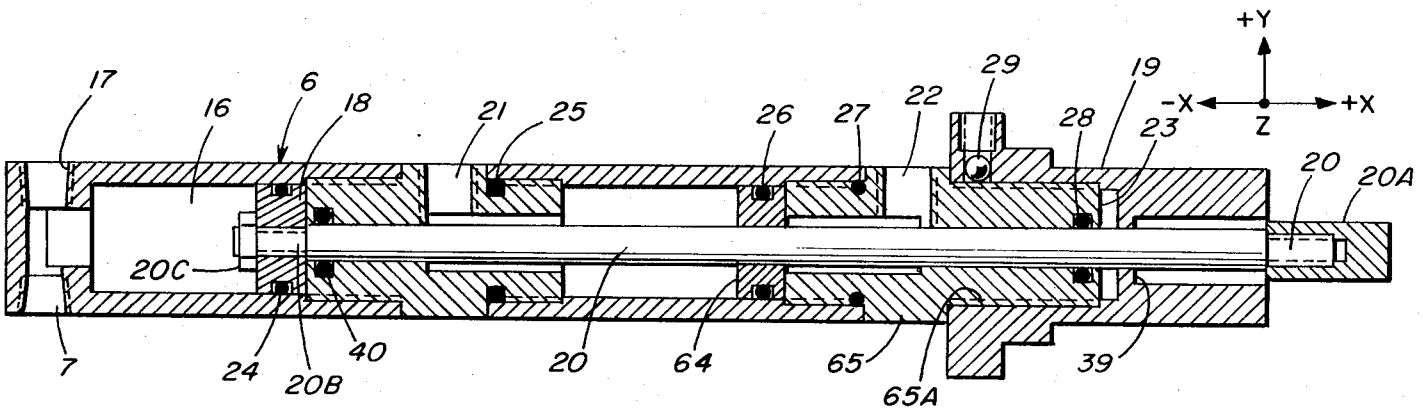
FIG. 7 is a longitudinal section view of a water pump to present precise metered amounts of water to be converted into steam.

Water vapor is created in a steam generator 5, FIG. 5, which is within and part of the contoured activator 1 in FIGS. 1–2 and is located immediately above (+Y direction) the steam cushion 3 in those figures. A precisely metered amount of water is delivered from an output 7 of a circular-cylindrical water pump 6 in FIG. 7 (see the explanation below) to a water input 8 to the generator 5 in FIG. 5. The generator 5 is generally rectangular in plan-view dimensions and is contoured at 9 to the contour of the top of the steam cushion 3. Steam is delivered through bottom holes 10 in central space 11 within an enclosure 12, as now explained.

The water is delivered to the enclosure 12 through the input 8 in FIG. 5 which is located at the back and at the center region of the enclosure 12. Water flows as two streams within channels 13A and 13B, to the left and right, respectively, in FIG. 5 and thence into channels 13C and 13D at the short ends of the rectangular enclosure 12. Heaters 14A and 14B (also shown in FIG. 2) at the left and right, respectively, heat the water in the channels 13C and 13D, respectively, to convert the water to steam which rises in the respective channels and enters through passages (e.g., 41A) to the central space 11. The water delivery system has a reverse pressure valve to prevent fluid flow back into the pump 6. Hence, there is a slight positive steam pressure within the space 11 which forces the steam downward through the holes 10 that are in communication with the cushion 3 and the pad 3A. In an actual system, the steam generator 5 consists of an upper aluminum casting 5A and a lower aluminum casting 5B. The heaters 14A and 14B deliver heat to the whole casting, but mostly in and around the channels 13C and 13D. However, that heat moves into the rest of the casting to maintain the temperature in the enclosure (or enclosed space) 11 at or slightly above the boiling temperature of water. Because the volume of water introduced to the steam generator 5 is so precisely controllable and because the amount of energy introduced to the generator 5 is also precisely controllable, the temperature of the vapor passing through the holes (or apertures) 10 can be controlled with precision. Thus, introduction of liquid water (which is to be avoided) to the upper 2 can be avoided and, indeed, the character of water vapor introduced to the upper 2 can be closely controlled and monitored. That precise control is an important aspect of the present invention. Another important aspect is now addressed.

The steam pad 3A and the activator housing 4 are shown pivotally opened in FIGS. 1 and 3 to receive the upper 2 and closed in FIG. 2. Separating the pad 3A and the activator housing 4 from one another and closing them upon one another, with the toe of the upper 2 therebetween, can present a problem. If the final closing, for example, has translational movement in the X-Z plane in FIG. 1, there can be scuffing of the upper 2. For that reason, the final movement of the pad 3A upon the activator housing 4 (with the upper 2 therebetween) is not angular movement, but is, rather, linear movement (about one inch in an actual machine). Hence, the pad 3A, in the final movement to press the upper 2 (FIG. 1) moves linearly in the minus Y-direction in FIG. 1 with no Z-direction movement, thereby to prevent scuffing of the upper 2. The linkage to perfect this linear movement is now discussed with reference to FIG. 4.

Figure 4:
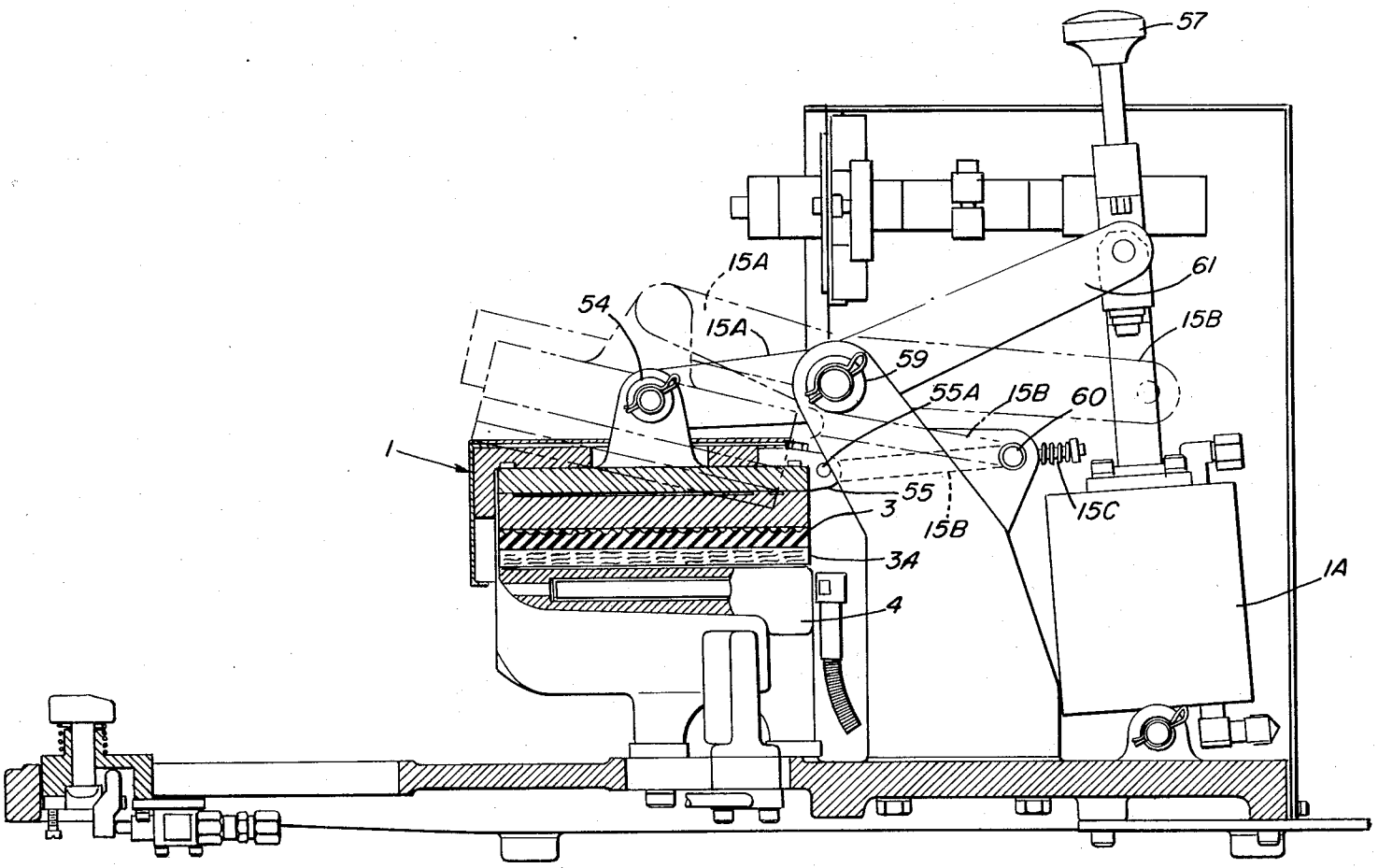
FIG. 4 is a side section view, taken on the line 4—4 in FIG. 2 and looking in the direction of the arrows, showing linkages within the steam toe press to permit the steam pads to be moved toward and away from each other in a desired fashion.

The linkage includes a link 15A, actuated about a pivot 59 in FIG. 4 by an arm 61 (of which the link 15A is an extension) powered by a double-acting air cylinder 1A, and a link 15B, the links 15A and 15B being two commonly acting linkages operating parallel to each other to maintain a perpendicular clamping force on the steam generator housing 5 in FIG. 5 (to lower the activator 1) starting about one inch above the clamped position, that is about one inch above the lower activator housing 4. Rotation of the steam generator 5 (FIG. 5) from the one-inch spaced position above the activator housing 4 is accomplished through pivoting between the lever arm 15A and the steam generator 5. Forced pivoting of the steam generator 5 compresses a link spring 15C, lengthening the link 15B to allow rotation of the steam generator 5 to occur about pivot 54. This rotation is intended to provide better presentation of the upper 2 without X-Z plane translational movement and, thus, no scuffing. In FIG. 4 the label 55 designates a pivot structure to move the link 15B about a pivot 55A.

Mention is made above of the importance of controlling the amount of liquid $H_2O$ introduced to the steam generator 5. That amount is very closely metered by the cylindrical pump or meter 6 in FIG. 7. Water, liquid in form, is introduced at an input port 17 to a water chamber 16 of the pump 6. The chamber 16 is filled by movement to position (+X) of a piston 18 through a piston 64 which is welded to a shaft 20. The pump 6 is a double-acting fluid pump which receives air (or other fluid) at an input port 21 to drive the piston 64, and hence the piston 18, to the right fill position in FIG. 7 and at an input port 22 to drive the piston 64, and hence the piston 18, to the left expel position. The movement to the right in FIG. 7 opens the chamber 16 to its capacity and movement to the left expels water (liquid) from the port 7. A shoulder 39 pressing against a knob 20A determines the length of stroke of the cylindrical, piston pump 6, and this stroke is controllable by threading a knob 19 in or out on threads of a sleeve 65. (The knob 20A is threaded on the right end of the shaft 20 and the piston 18 is held by a nut 20C threaded on the left end, labeled 20B, of the shaft 20.) The amount of water in liquid form expelled at the port 7 (FIG. 7) to the input port 8 (FIG. 5) is coupled with the heat energy introduced by the heaters 14A and 14B very precisely to determine the character of the water vapor introduced to the pad 3A. The labels 24, 25, 26, 27, 28 and 40 in FIG. 7 designate O-ring seals. The label 29 designates a sphere which enters a detente to lock the knob 19 in each of several positions. The liquid input at 17 can come from an outside water source or from a bottle. The steam and electric system is now discussed with reference to FIG. 6.

Figure 6:
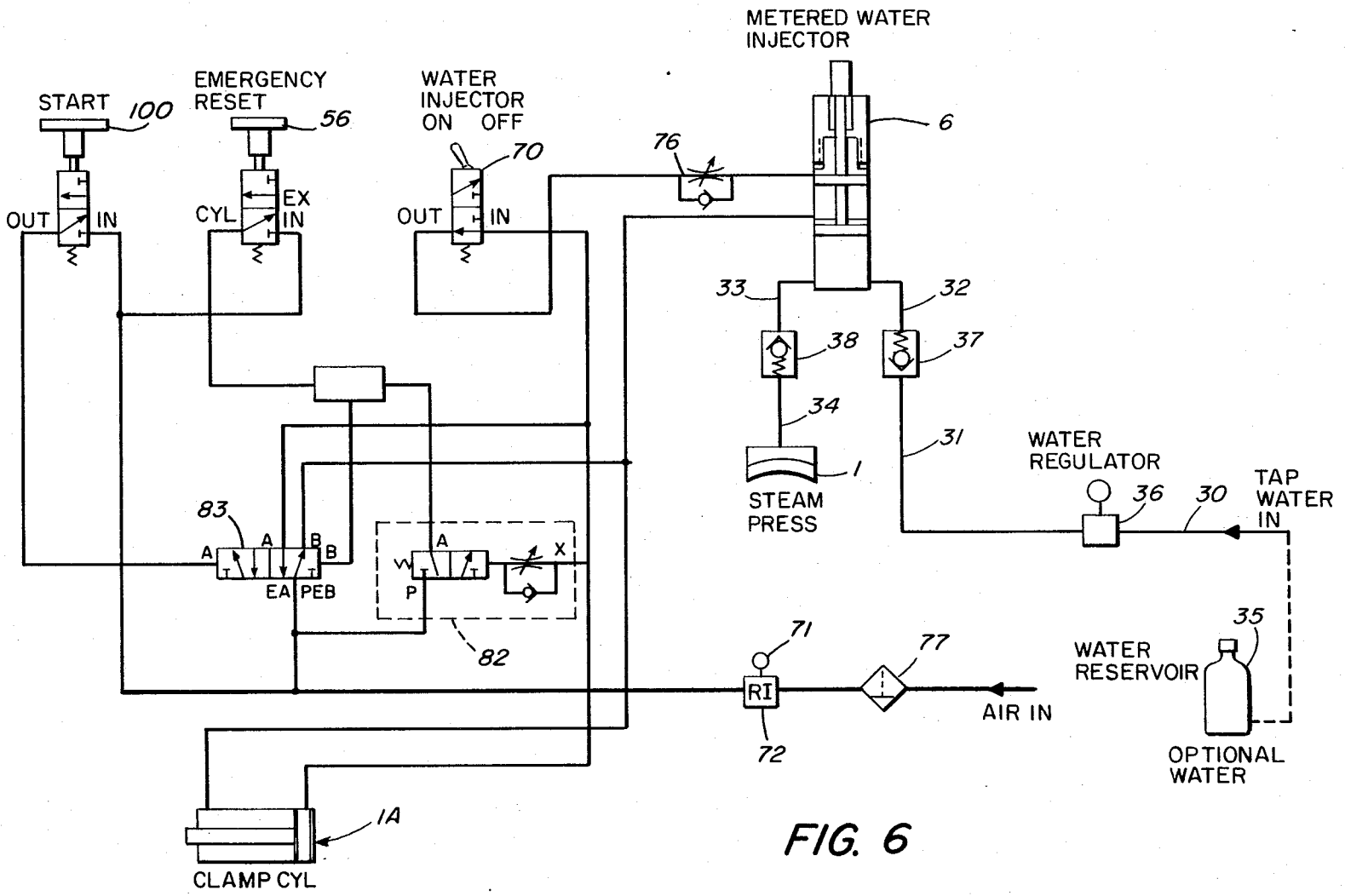
FIG. 6 is a schematic showing of pneumatic and liquid portions of the steam toe press of FIG. 1.

In FIG. 6, the contoured activator is shown diagrammatically at 1 and the water pump is shown diagrammatically at 6. The lines labeled 30–34 are water lines from a water tap or a water reservoir 35 through a water regulator 36 and a one-way valve 37 to the pump 6, thence to another one-way valve 38 to the contoured activator 1.

Air to actuate the pump 6 comes from a source through various pneumatic panel controls that include a water pump air on/off switch 70. a clamping air pressure regulator 72 (50 to 100 psi), through an indicator gage 71. The selection of a desired cycle time is achieved by use of a timer 82.

Figure 8:
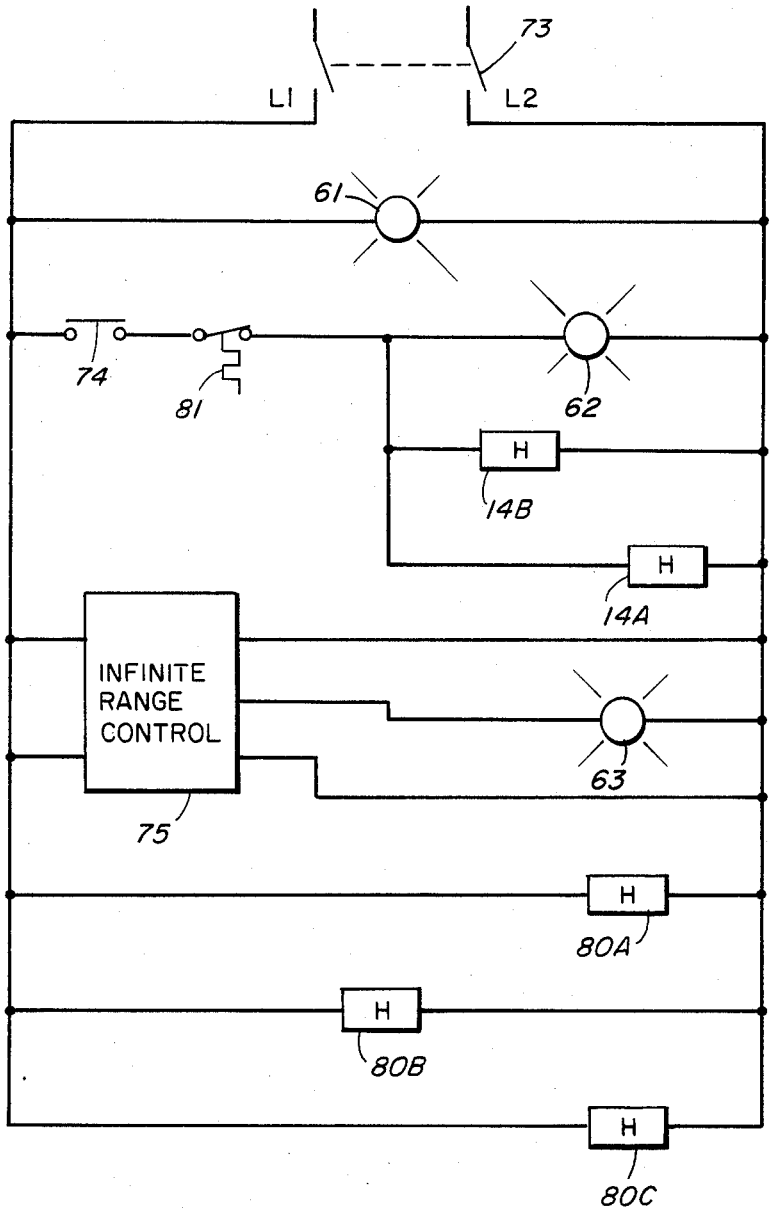
FIG. 8 shows diagrammatically electrical circuitry in the steam toe press of FIG. 1.

Electrical panel controls for the desired setup include a power on/off switch 73 in FIG. 8, a steam generator on/off switch 74 which is in series with a preset thermostat 81 set at 350 degrees F. to control the steam heaters 14A and 14B. Infinite heater control 75 is used to control the heaters 80A, 80B and 80C, as shown in FIGS. 2 and 8.

The sequence of operation is an operator fits and upper 2 on a last 84, then inserts the upper between the the steam housing 1 and the activator housing 4, pressing momentarily on a start bar 100 (FIGS. 1 and 6). A pneumatic power valve 83 in FIG. 8 shifts starting the following actions: the steam generator housing clamps, a start-of-cycle countdown begins in the timer 82, a metered amount of water is injected by the water pump 6 into the steam generator 5, the timer 82 count out and end of cycle and shifts the power valve 83 to reverse cycle action, the latter being that the steam generator housing 1 opens and the chamber 16 of the water pump 6 is filled to be ready for a new cycle.

A few further machine parts are noted in this paragraph: the label 56 designates an emergency release (FIGS. 2 and 6); 57 designates a knob that threads unto the shaft of the air cylinder 1A to control the height of clamp by controlling the length of the stroke of the double-acting air cylinder 1A in FIGS. 4 and 6; 71 designates a gage; 72 designates a regulator control; 77 designates a water trap and air filter; 76 designates a flow control to the pump 6; and 61, 62 and 63 in FIG. 8 designate lamps.

Modifications of the invention herein disclosed will occur to persons skilled in the art and all such modifications are deemed to be within the scope of the invention as defined by the appended claims.

What is claimed is:

1. A steam press for steaming the toe region of a footwear upper, that comprises:

a contoured activator to receive the toe portion of the upper and operable to heat and apply steam to said toe portion, which contoured activator includes a contoured cushion and a contoured steam pad, the latter to engage the top of the upper, and a heated activator housing contoured to the contour of the contoured steam pad and positioned to mate with the contoured steam pad and press the upper therebetween, said contoured steam pad being operable to move away from and toward the heated activator housing respectively to receive the upper and then press the upper therebetween and a steam generator connected to receive water in the liquid state and operable to convert the water to steam; and a water injector mechanism connected to introduce a metered and controllable amount of water to the steam generator which converts the water to steam that flows into the first steam pad and thence to the upper.

2. A steam toe press according to claim 1 in which the water injection mechanism comprises a cylinder having a chamber to receive water, the volume of the chamber being precisely controllable to permit accurate metering the amount of water introduced to the steam generator.

3. A steam toe press according to claim 2 in which the cylinder includes a piston that forms one end of a chamber and which is movable axially to change the volume of the chamber and a double-acting hydraulic actuator portion that serves to move the piston axially respectively to reduce and increase the size of the chamber.

4. A steam toe press according to claim 3 in which the axial movement of the piston is precisely controllable to permit precise control of the amount of water introduced into the steam generator.

5. A steam toe press according to claim 1 in which the steam generator comprises an enclosure to receive the water which is introduced to the center region of the enclosure and flows within channels in the enclosure as two streams to the ends of the enclosure and heaters at each end of the enclosure to vaporize the water to create steam which exits from the channels through ports at the top of the channel walls and enters a central space within the enclosure, said enclosure having a perforated bottom wall through whose perforations the steam moves under slight pressure to enter the contoured cushion and through the contoured steam pad.

6. A steam toe press according to claim 1 having a double linkage connected to one end of the base of the press and at the other end to the contoured activator, which linkage serves to pivot the contoured steam pad away from the heated activator housing to permit the upper to be introduced between the contoured steam pad and the heated activator housing, and then serves to pivot the contoured steam pad toward the heated activator housing to press the upper therebetween, there being a slight gap between the contoured steam pad and the heated activator housing when the pivoting has been completed, there being a further downward linear movement of the contoured steam pad toward the heated activator housing to press the upper therebetween, said linear movement assuring required pressure by the contoured steam pad and the heated activator housing upon the upper while nevertheless preventing scuffing of the upper as the contoured steam pad and the heated activator housing are moved toward one another.

7. A steam press for steaming the toe region of a footwear upper, that comprises:

a contoured activator to receive the toe portion of the upper and operable to heat and apply steam to said toe portion, which contoured activator includes contoured cushion means and the like to engage the top of the upper, and a heated activator housing contoured to the contour of the contoured cushion and positioned to mate with the contoured steam pad and press the upper therebetween, said contoured cushion means and the like being operable to move away from and toward the heated activator housing respectively to receive the upper and then press the upper therebetween, and a steam generator connected to receive water in the liquid state and operable to convert the water steam; and a water injector mechanism connected to introduce a metered and controllable amount of water to the steam generator which converts the water to steam that flows into the contoured cushion means and thence to the upper.

8. A steam toe press according to claim 7 in which the water injection mechanism comprises a cylinder having a chamber to receive water, the volume of the chamber being precisely controllable to permit accurate metering of the amount of water introduced to the steam generator.

9. A steam press for steaming the toe region of a footwear upper, that comprises:

a contoured activator to receive the toe portion of the upper and operable to heat and apply steam to said toe portion, which contoured activator include contoured porous means to engage the top of the upper, and a heated activator housing contoured to the contour of the contoured porous means and positioned to mate with the contoured porous means and press the upper therebetween a mechanical linkage connected to move said contoured porous means from and toward the heated activator housing respectively to receive the upper and then press the upper therebetween, and a steam generator connected to receive water in the liquid state and operable to convert the water steam; and a water injector mechanism connected to introduce a metered and controllable amount of water to the steam generator which converts the water to steam that flows into the contoured porous means and thence to the upper.

10. A steam toe press according to claim 9 in which the water injection mechanism comprises a cylinder having a chamber to receive water, the volume of the chamber being precisely controllable to permit accurate metering the amount of water introduced to the steam generator.

11. A steam toe press according to claim 10 in which the cylinder includes a piston that forms one end of a chamber and which is movably axially to change the volume of the chamber and a double-acting hydraulic actuator portion that serves to move the piston axially respectively to reduce and increase the size of the chamber.

12. A steam toe press according to claim 11 in which the axial movement of the piston is precisely controllable to permit precise control of the amount of water introduced to the steam generator.

* * * * *